US006059121A

United States Patent [19]

Hirose

[11] Patent Number: 6,059,121

[45] Date of Patent: May 9, 2000

[54] APPARATUS FOR SELECTING COMPONENT PARTS AND STAKING PRESS EQUIPPED WITH THAT APPARATUS

[75] Inventor: Shunzo Hirose, La Mirada, Calif.

[73] Assignee: Amada MFG America Inc., La Mirada, Calif.

[21] Appl. No.: 08/628,869

[22] Filed: Apr. 5, 1996

[51] Int. Cl.[7] ..... B07C 5/00

[52] U.S. Cl. ..... 209/559; 209/939; 83/102; 29/720

[58] Field of Search ..... 209/576, 577, 209/583, 587, 939, 922, 559; 83/55, 76.6, 76.7, 76.8, 102, 167; 29/714, 716, 720, 721, 787, 788, 790

[56] References Cited

U.S. PATENT DOCUMENTS

| | | | |
|---|---|---|---|
| 3,932,931 | 1/1976 | Wright | 29/720 X |
| 4,374,451 | 2/1983 | Miller | 29/430 X |
| 4,646,404 | 3/1987 | Matsui | 209/924 X |
| 4,703,679 | 11/1987 | Hayashi et al. | 83/102 |
| 5,468,941 | 11/1995 | Sasaki | 209/534 X |

FOREIGN PATENT DOCUMENTS

| | | | |
|---|---|---|---|
| 203659 | 12/1986 | European Pat. Off. | 209/583 |

*Primary Examiner*—Tuan N. Nguyen
*Attorney, Agent, or Firm*—Blank Rome Comisky & McCauley LLP

[57] ABSTRACT

A staking press equipped with a component parts selecting apparatus. The staking press is equipped with a component parts supplying unit (17) that has a plurality of component parts storage sections (19, 23) each for storing a plurality of the same component parts. The component parts selecting apparatus includes a device (11) for picking up an image of a mark (m) provided on a surface of a workpiece (W), a parts identifying device (13) for identifying a component part to be installed on the workpiece on the basis of image data from the picking up device (11), a controller (15) for identifying the component parts storage section (19,23) that stores the component parts to be installed in a workpiece on the basis of data from the parts identifying device.

11 Claims, 4 Drawing Sheets

APPARATUS FOR SELECTING COMPONENT PARTS AND STAKING PRESS EQUIPPED WITH THAT APPARATUS

BACKGROUND OF THE INVENTION

1. Field of the Invention

The present invention relates to an apparatus for selecting component parts and a staking press equipped with that apparatus, and more specifically to an apparatus for selecting component parts such as nuts and bolts, and to a staking press equipped with that apparatus, the staking press being for installing component parts in a workpiece such as a sheet metal by staking operations.

2. Description of the Prior Art

There exists a well known staking press for installing component parts, such as nuts and bolts, in a workpiece, such as a sheet metal, by staking operations. In this case, a nut, for example, is first inserted into a prepared insertion hole (hereinafter referred simply to as insertion hole) formed in a sheet metal, and then the nut is embedded into the sheet metal by pressing the nut deep into the insertion hole of the sheet metal and causing plastic flow at the joint.

In more detail, as shown in FIG. 1A, first an insertion hole (mounting hole) h having a diameter corresponding to the size of an insertion shank i of a nut (component part) N is pierced in a sheet metal W. Then, the sheet metal W is mounted on an anvil A, the shank i of the nut N is inserted into the insertion hole h and the nut N is pressed deep into the insertion hole h by lowering a punch P to cause plastic flow of the metal around a knurled section of the shank i of the nut N, as shown in FIG. 1B.

In the above-mentioned staking process, when a plurality of component parts are to be installed in the sheet metal, a component part suitable for each insertion hole must be correctly selected from a plurality of component parts. However, this selection process has so far been carried out in dependence upon human labor. As a result, there exists problems of low work efficiency and, in addition, erroneous selection of component parts inevitably occurs, so that defective products have often been produced. In particular, although the diameter of the shank of the bolts or nuts is the same, when the sizes or other dimensions (the models or sorts) of the bolts or nuts are different from each other, the problem of possible erroneous component parts selection increases.

SUMMARY OF THE INVENTION

With these problems in mind, therefore, it is the object of the present invention to provide an apparatus for selecting component parts and a staking press equipped with that apparatus, the apparatus being able to automatically identify component parts to be installed in a workpiece.

To achieve the above-mentioned object, the present invention provides a component parts selecting apparatus that includes means (11) for picking up an image of a mark (m) provided on the surface of a workpiece (W), parts identifying means (13) for identifying a component part to be installed on the workpiece on the basis of image data from the picking up means (11), control means (15) for identifying on the basis of data from the parts identifying means a component parts storage sections (19, 23) that stores the component part to be installed in a workpiece.

Each component parts storage section (19, 23) is preferably provided with a visually indicating means (21) which can be turned on and off, wherein the control means (15) turns on a visually indicating means (21) associated with a storage section that stores the component part corresponding to the mark (m) on the basis of the data from the parts identifying means (13).

Each component parts storage section (19, 23) is further preferably provided with parts feeder means (23) for sequentially supplying component parts (23) and means (27) for detecting the shape of each component part sequentially discharged from the parts feeder means (23), wherein the controller (15) compares the data from the parts identifying means (13) with data from the means (27) for detecting the shape of each component part discharged from the parts feeder means (23). With this modification, a wrong component part that could be erroneously stored in a parts feeder means can be easily detected.

DESCRIPTION OF THE PREFERRED EMBODIMENTS

Figure 1A:
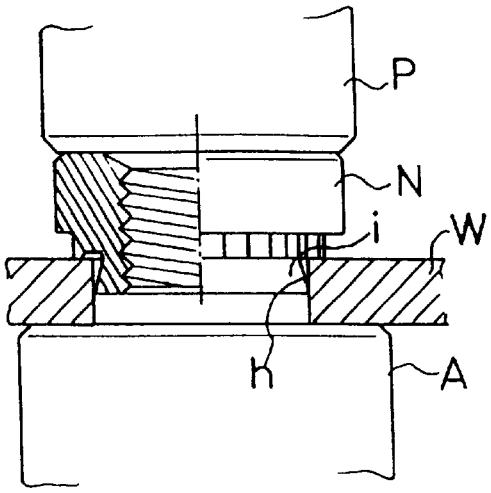
FIGS. 1A and 1B are cross-sectional views showing a staking operation by which a nut is installed in a sheet metal.
Figure 1B:
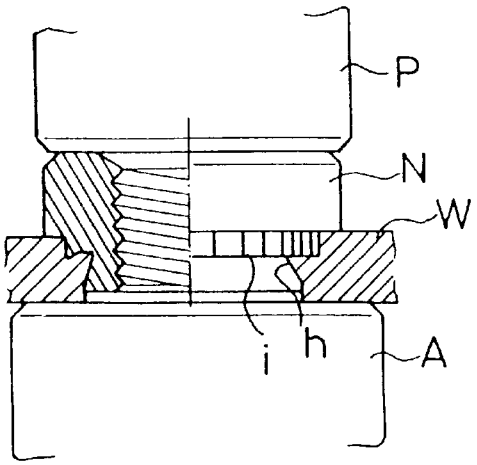
Figure 2:
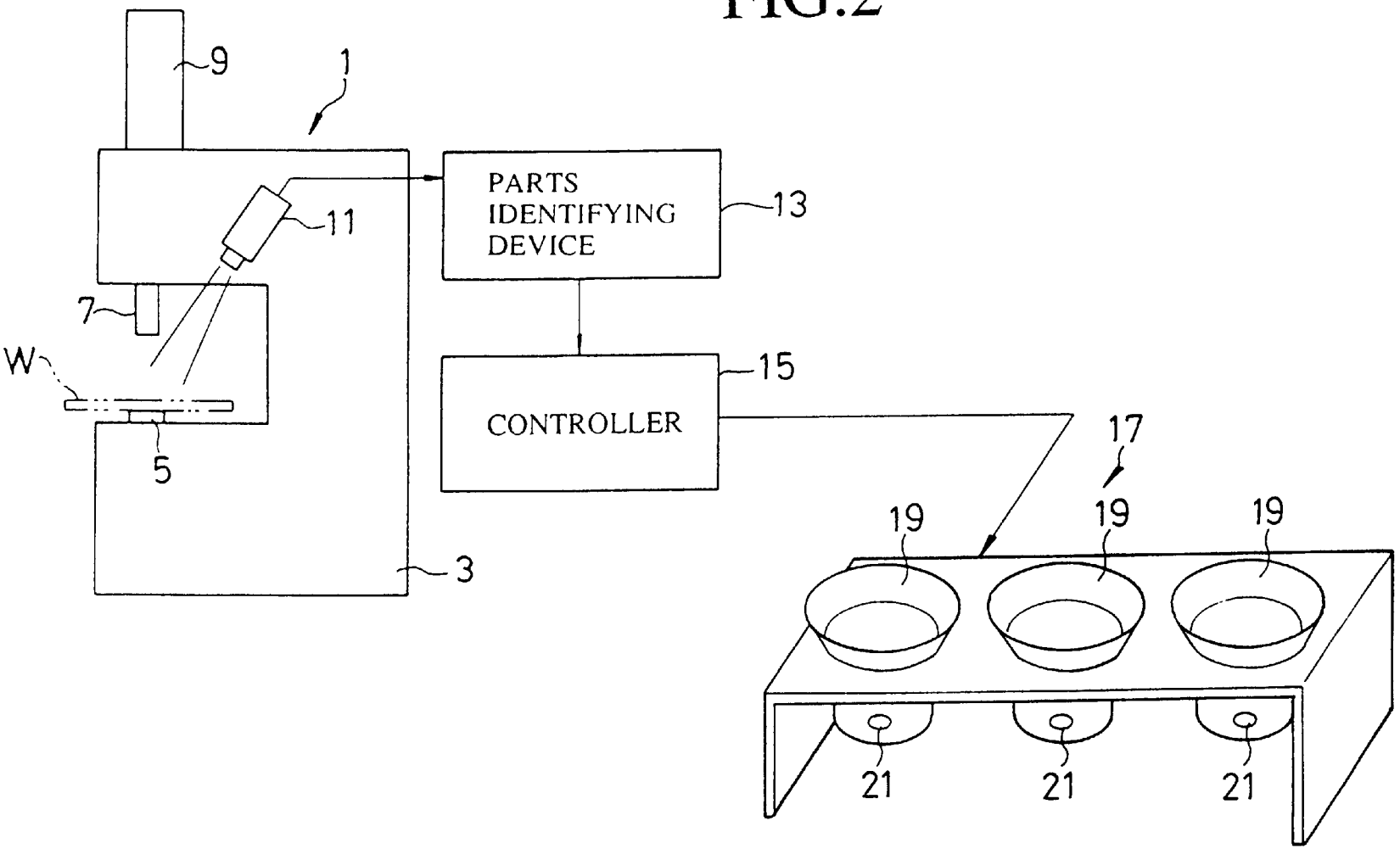
FIG. 2 is a schematic block diagram showing a first embodiment of the component parts selecting apparatus according to the present invention and a staking press equipped with the component parts selecting apparatus.

FIG. 2 shows a first embodiment of an apparatus for selecting component parts (referred in this specification simply as component parts selecting apparatus) according to the present invention, and the staking press equipped with the component parts selecting apparatus. In the drawing, a staking press 1 is roughly composed of an anvil 5 mounted on the lower side of a frame 3, a punch 7 arranged on the upper side of the frame 3 so as to be movable up and down relative to the anvil 5 and a hydraulic cylinder unit 9 for driving the punch 7 up and down. A sheet metal W in which component parts are to be installed is placed on the anvil 5.

Figure 3A:
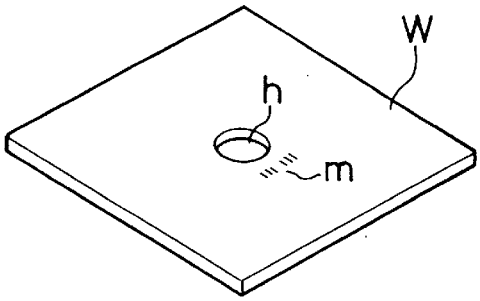
FIGS. 3A and 3B are perspective views showing sheet metals used with the first embodiment of the component parts selecting apparatus.
Figure 3B:
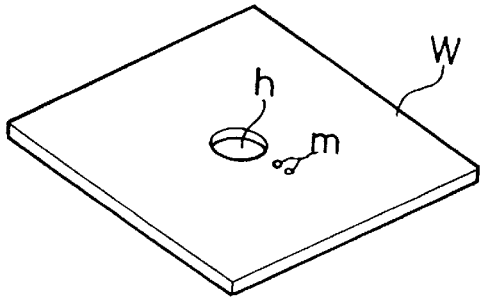

As shown in FIGS. 3A and 3B, a hole h having a predetermined diameter has been pierced in the sheet metal W by another punch press (not shown); this hole h is hereinafter referred to simply as an insertion hole. Further, a mark m for identifying a component part to be installed to the hole h has been engraved in the vicinity of the insertion hole h. This mark m, for instance, is a bar code mark as shown in FIG. 3A or a symbol mark as shown in FIG. 3B.

Referring again to FIG. 2, a video camera 11 is mounted on the frame 3 for picking up or detecting the image of the upper surface portion of the anvil 5, that is, the image of the mark m formed in the vicinity of the insertion hole h in the sheet metal W placed on the anvil 5.

An image picked up or detected by the video camera 11 is outputted to a component parts identifying device (hereinafter referred to simply as a parts identifying device) 13. The parts identifying device 13 is an image processing unit provided with a computer that can identify the mark m on the basis of the image data obtained by the video camera 11 and in accordance with a suitable shape recognition method. Specifically, the parts identifying device 13 outputs identification data (hereinafter referred as to detected parts-identification data) such as a number 1, 2,. . . n corresponding to the mark m and to a component part to be installed in the insertion hole h. The detected parts-identification data are outputted to a controller 15 for controlling a parts supplying unit 17. The parts supplying unit 17 arranged near the staking press 1 is provided with a plurality of hoppers 19 for storing different component parts, each hopper 19 being provided with a display lamp 21.

Identification data, such as numbers for identifying the component parts stored in the respective hoppers 19 (referred hereinafter as to reference parts-identification data), is stored in the controller 15 and the controller 15 compares the detected parts-identification data with the reference parts-identification data. When the detected parts-identification data match any one of the reference parts-identification data, the controller 15 lights the lamp 21 on the hopper 19 that stores a component part corresponding to the detected parts-identification data.

In operation, first the sheet metal W is placed on the staking press 1 in such a way that the insertion hole h is located on the anvil 5. After the sheet metal W is placed on the anvil 5, the operation of the parts identifying device 13 is started so that the image of the mark m formed in the vicinity of the insertion hole h is picked up by the video camera 11. The image of the mark m picked up by the video camera 11 are inputted to the parts identifying device 13. The parts identifying device 13 decode the inputted image by a suitable shape recognition method and outputs the detected parts-identification data corresponding to the mark m. The controller 15 compares the detected parts-identification data with the reference parts-identification data to detect the reference parts-identification data that matches the detected parts-identification data, and then lights a lamp 21 on the hopper 19 associated with the reference parts-identification data.

Thus, the operator can securely recognize the hopper 19 that stores the component part to be installed in the insertion hole h from the illumination of the lamp 21. That is, the operator takes out one of the component parts from the hopper 19 in which the lamp 21 is lit.

Figure 4:
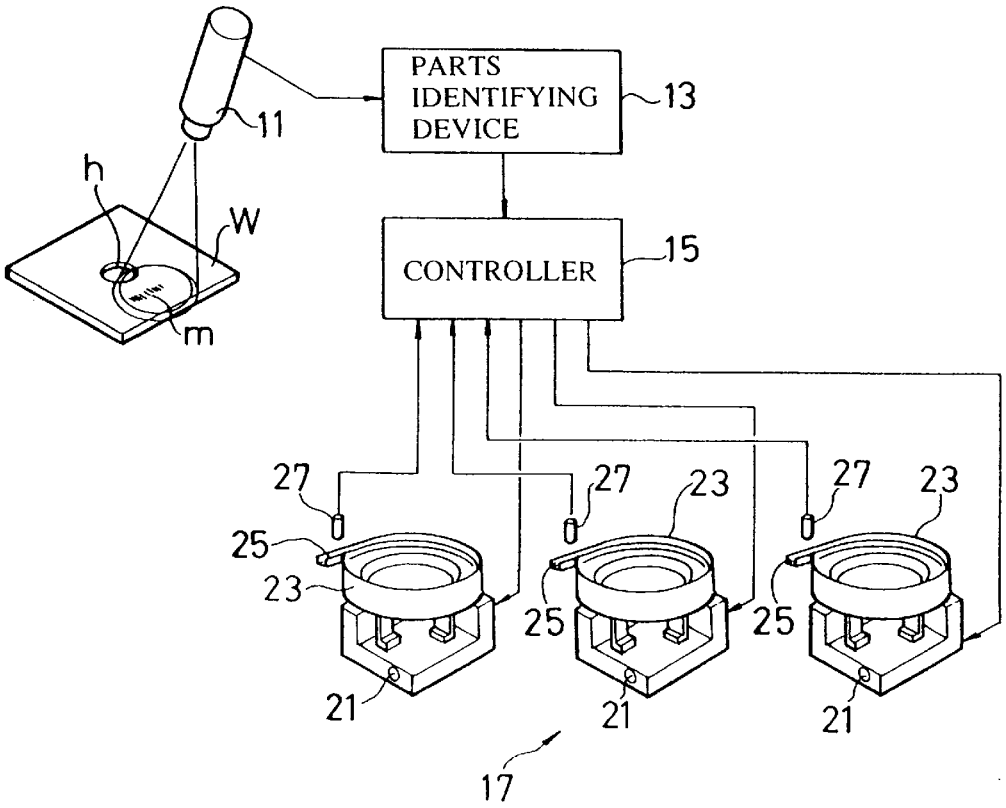
FIG. 4 is a schematic block diagram showing a second embodiment of the component parts selecting apparatus according to the present invention.

FIG. 4 shows a second embodiment of the component parts selecting apparatus for a staking press according to the present invention in which the same reference numerals have been retained for the similar component parts or elements which have the same functions as with the case of the first embodiment shown in FIG. 2.

In this embodiment, a component parts supplying unit 17 is composed of a plurality of vibration type parts feeders 23 each of which can supply the same kind of component part. Specifically, a plurality of the same component parts are stored in each parts feeder 23. (Therefore, whenever the component parts are changed, the parts feeder 23 having the old component parts is replaced with a new parts feeder having new component parts, or the old component parts stored in the parts feeder 23 with new component parts). However, different component parts might be erroneously stored in a part feeder 23 by chance.

To detect the component parts erroneously stored in the part feeder 23, the component part supplying unit 17 of this embodiment is further provided with a sensor 27 for physically detecting component parts (hereinafter referred simply as to parts detecting sensor) stored in the parts feeder 23. Specifically the parts detecting sensor 27 detects the component parts located on a parts feed-out passage 25 of each parts feeder 23. This parts detecting sensor 27 is a device for detecting the shapes and dimension of the components parts, such as a video camera, laser sensor and the like, or a device for detecting the weights of the component parts. Specifically, the parts detecting sensor 27 detects various parts data such as shapes, dimensions, weight and the like of the component parts stored in the parts feeder 23 and transmits the obtained parts data to the controller 15. The controller 15 compares parts-identification data from the parts identifying device 13 with the pats data from the parts detecting sensor 27. When the identification data from the device 13 does not corresponds to the parts data from the parts detecting sensor 27, the controller 15 stops the feeding operation of the parts feeder 23 and an alarm signal such as an alarm sound or light is generated. When the alarm signal is being generated, it is preferable to stop the operation of the staking press for safety. After the erroneously stored component part is removed, the operation of the parts feeders 23 is restarted by the operator depressing a reset switch (not shown).

In operation of the second embodiment, after the sheet metal W has been placed on a staking press so that the insertion hole h is positioned on the anvil 5, a switch for starting the operation of the parts identifying device 13 is depressed and the video camera 11 directed at the vicinity of the insertion hole h begins detection of the mark m formed near the insertion hole h.

The image data of the mark m obtained by the video camera 11 are inputted to the parts identifying device 13. The parts identifying device 13 determines the component part to be installed in the insertion hole h by decoding the image data of the mark m and outputs a detected parts-identification data corresponding to the mark m. The controller 15 compares the detected parts-identification data from the parts identifying device 13 with the reference parts-identification data stored therein and lights a lamp 21 on the feeder 23 that (nominally) stores the component parts corresponding to the mark m. Then the controller 15 takes the parts data from the sensor 17 on the parts feeder 23 having the lit lamp 23 and compares the parts data with the detected parts-identification data from the parts identifying device 13 and checks whether the component part located on the passage 25 of the parts feeder 23 is the correct component part. If the parts data from the sensor 27 corresponds to the detected parts-indentification data from the device 13 (which means that the component part under the sensor 27 is the correct component part), the controller 15 activates the parts feeder 23 so that the component part corresponding to the mark m is supplied from the parts feeder 23. If the parts data from the sensor 27 does not corresponds to the detected identification data from the device 13 (which means that the component part under the sensor 27 is a component part erroneously stored in the feeder 23), the controller 15 stops the operation of the parts feeder 23 and generates an alarm sound or turns on an alarm lamp. It is preferable to stop the operation of the staking press for safety while the alarm is being generated. After the erroneously stored component part is removed from the passage 25, the operation of the parts feeder 23 is restarted by the operator depressing a reset switch.

With this embodiment, a wrong component part that could be erroneously stored in a parts feeder means can be easily detected, so that component parts suitable for respective insertion holes h is reliably supplied from the parts feeder 23.

In the above-mentioned embodiments, the parts to be installed in the insertion hole h have been identified by the mark m engraved near the insertion hole h. However, it is also possible to identify the parts to be installed in the hole h by picking up the image of the insertion hole h itself by a video camera 11 and detecting the diameter (size) thereof from the recorded image. In this case the marks m on the sheet metal are unnecessary.

Figure 5:
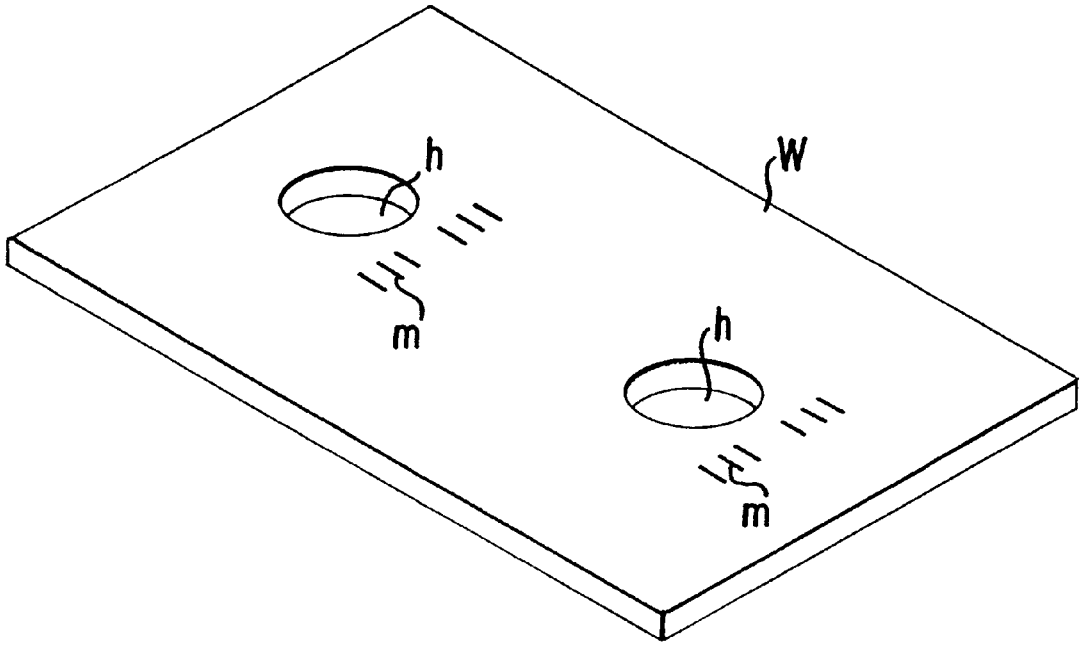
FIG. 5 is a perspective view showing another sheet metal used with the component parts selecting apparatus.

As described above, in the parts selecting apparatus according to the present invention, component parts to be installed in insertion holes formed in a sheet metal, such holes being shown e.g., in FIG. 5, can be reliably identified on the basis of marks formed on a workpiece by the illumination of the indication lamp. This eliminates the possibility of erroneous selection of the component parts; in other words the correct component parts can be securely taken out of the parts storing sections. Further, when a wrong component part is stored in the parts feeder of a parts storing section, the operation of the parts feeder is stopped and the selection of the component parts is more reliably carried out.

It is to be further understood by those skilled in the art that only specific embodiments have been described in detail by way of example and that various changes and modifications may be made in the invention without departing from the spirit and scope thereof.

What is claimed is:

1. A component parts selecting apparatus for a staking press, the staking press being equipped with a component parts supplying unit that has a plurality of component parts storage sections each for storing a plurality of the same component parts, the apparatus comprising:

means for picking up an image of a mark provided on a surface of a workpiece, the mark being for identifying a component part to be installed on the workpiece;

parts identifying means for identifying a component part to be installed on the workpiece on the basis of image data from the picking up means;

control means for identifying a component parts storage section that stores the component parts to be installed in a workpiece on the basis of data from the parts identifying means.

2. The component parts selecting apparatus of claim 1, wherein each storage section is provided with a visual indicating means, and the control means activates the visual indicating means associated with a storage section that stores component parts corresponding to the mark on the basis of the data from the parts identifying means.

3. The component parts selecting apparatus of claim 1, wherein each component parts storage section is provided with parts feeder means for sequentially supplying component parts and means for detecting a shape of each component part discharged from the parts feeder means, and the controller compares the data from the parts identifying means with data from the means for detecting the shape of each component part discharged from the parts feeder means.

4. The component parts selecting apparatus of claim 1, wherein the mark is in a vicinity of a hole into which the component part is to be installed, and the picking up means comprises means for picking up the image of the mark in the vicinity of the hole.

5. The component parts selecting apparatus of claim 4, wherein the workpiece has a plurality of said holes, and the picking up means comprises means for picking up the image of the mark in the vicinity of one of the plurality of said holes.

6. A staking press system for embedding a component part in a hole provided in a workpiece, comprising:

an anvil for supporting the workpiece;

a punch for applying a squeezing force onto a component part inserted in the hole;

a component parts supplying unit that has a plurality of component parts storage sections each for storing a plurality of the same component parts;

means for picking up an image of a mark provided on a surface of a workpiece, the mark being for identifying a component part to be installed on the workpiece;

parts identifying means for identifying a component part to be installed on the workpiece on the basis of image data from the picking up means;

control means for identifying a component parts storage section that stores the component parts to be installed in a workpiece on the basis of data from the parts identifying means.

7. The staking press of claim 6, wherein each storage section is provided with a visual indicating means, and the control means activates the visual indicating means associated with a storage section that stores component parts corresponding to the mark on the basis of the data from the parts identifying means.

8. The staking press of claim 6, wherein each component parts storage section is provided with parts feeder means for sequentially supplying component parts and means for detecting a shape of each component part discharged from the parts feeder means, and the controller compares the data from the parts identifying means with data from the means for detecting the shape of each component part discharged from the parts feeder means.

9. The staking press of claim 6, wherein the mark is in a vicinity of the hole, and the picking up means comprises means for picking up the image of the mark in the vicinity of the hole.

10. The staking press of claim 9, wherein the workpiece has a plurality of said holes, and the picking up means comprises means for picking up the image of the mark in the vicinity of one of the plurality of said holes.

11. The staking press of claim 9, wherein the picking up means comprises means for picking up an image of an upper surface portion of the anvil so as to pick up the image of the mark.

* * * * *